United States Patent [19]

Dennis et al.

[11] 4,339,896

[45] Jul. 20, 1982

[54] ABRASIVE COMPACT DRESSING TOOLS, TOOL FABRICATION METHODS FOR DRESSING A GRINDING WHEEL WITH SUCH TOOLS

[75] Inventors: Mahlon D. Dennis, Columbus, Ohio; Frank R. Skinner, St. Joseph, Mich.

[73] Assignee: General Electric Company, Worthington, Ohio

[21] Appl. No.: 906,288

[22] Filed: May 15, 1978

Related U.S. Application Data

[63] Continuation-in-part of Ser. No. 805,759, Jun. 13, 1977, abandoned.

[51] Int. Cl.³ ..... B24D 17/00

[52] U.S. Cl. ..... 51/298; 51/297; 51/307; 51/308; 51/309; 125/39

[58] Field of Search ..... 51/297, 307, 308, 309, 51/298; 125/39, 11 R, 11 AT

[56] References Cited

U.S. PATENT DOCUMENTS

| | | | |
|---|---|---|---|
| 2,404,184 | 7/1946 | Ludel | 125/39 |
| 2,791,211 | 5/1957 | Nagy | 125/39 |
| 2,854,966 | 10/1958 | Ladinsky | 125/39 |
| 3,743,489 | 7/1973 | Wentorf et al. | 51/307 |
| 3,767,371 | 10/1973 | Wentorf et al. | 51/307 |
| 3,850,591 | 11/1974 | Wentorf | 51/307 |

FOREIGN PATENT DOCUMENTS

| | | | |
|---|---|---|---|
| 129199 | 12/1976 | German Democratic Rep. | 125/39 |
| 568127 | 10/1975 | Switzerland . | |
| 690047 | 4/1953 | United Kingdom . | |

OTHER PUBLICATIONS

Oberg et al., Machinery's Handbook (20th Edition) pp. 1991–1997; 1975.

*Primary Examiner*—Donald E. Czaja
*Assistant Examiner*—W. Thompson
*Attorney, Agent, or Firm*—Douglas B. Little; Dennis A. Dearing

[57] ABSTRACT

A method for dressing a grinding wheel, comprising the step of engaging the periphery of a rotating grinding wheel with a dressing tool composed at a positive back rake angle and optionally at a positive side rake angle. The dressing tool is preferably comprised of a composite compact having a first layer of bonded abrasive crystals of diamond or CBN and a second layer of cemented tungsten carbide bonded to the first layer. The compact may be provided with a side cutting edge angle between 0° and 90° and an end edge cutting angle between 0° and 45°.

13 Claims, 10 Drawing Figures

ABRASIVE COMPACT DRESSING TOOLS, TOOL FABRICATION METHODS FOR DRESSING A GRINDING WHEEL WITH SUCH TOOLS

CROSS REFERENCE TO RELATED APPLICATIONS

This is a continuation-in-part of U.S. application Ser. No. 805,759; filed June 13, 1977, now abandoned.

BACKGROUND OF THE INVENTION

This invention relates to methods for dressing grinding wheels and, more particularly, relates to dressing methods using abrasive compacts.

As set forth in Oberg et al., *Machinery's Handbook,* p. 1991 (20th Ed., 1976): "The perfect grinding wheel operation under ideal conditions will be self sharpening; i.e., as the abrasive grains become dull, they will tend to fracture and be dislodged from the wheel by the grinding forces, thereby exposing, new, sharp abrasive grains. While in precision machine grinding this ideal may be partially attained in some instances, it is almost never attained completely. Usually, the grinding wheel must be dressed and trued after mounting on the precision grinding machine spindle and periodically thereafter.

Dressing may be defined as any operation performed on the face of a grinding wheel that improves its cutting action. Trueing is a dressing operation but is more precise, i.e., the face of the wheel may be made parallel to the spindle or made into a radius or special shape. Regularly applied trueing is also needed for the accurate size control of the work, particularly in automatic grinding."

Opening is another dressing operation and refers to the breaking away of the bond material from around the abrasive particles in a wheel thereby exposing them for grinding. A new wheel is initially opened and may have to be periodically opened thereafter to expose new particles when the previously exposed particles have been dislodged or dulled and to remove grinding swarf, which may accumulate during grinding, from around the abrasive particles.

A cluster compact is defined as a cluster of abrasive particles bonded together either (1) in a self-bonded relationship, (2) a means of bonding medium disposed between the crystals, (3) by means of some combination of (1) and (2). Reference can be made to U.S. Pat. Nos. 3,136,615; 3,141,746 and 3,233,988 for a detailed disclosure of certain types of compacts and methods for making same. (The disclosure of these patents are hereby incorporated by reference herein.)

A composite compact is defined as a cluster compact bonded to a substrate material such as cemented tungsten carbide. A bond to the substrate can be formed either during or subsequent to the formation of the cluster compact. Reference can be made to U.S. Pat. Nos. 3,745,623; 3,743,489 and 3,767,371 for a detailed disclosure of certain types of composite compacts and methods for making same. (The disclosure of these patents are hereby incorporated by reference herein.)

A table of a dressing tool is the tool surface against which chips of the grinding wheel bear as they are being severed.

Rake angle refers to the angle of engagement of a dressing tool with a wheel as measured from the tool table as a plane of reference. Back rake angle is defined herein as the angle measured in a plane perpendicular to the wheel spindle which is formed between the table of the tool and a line originating at the center axis of the wheel and extending radially outward through the line or point of intersection of the wheel surface and said table of the tool tip. Back rake angles are considered to be positive when measured in the direction of wheel rotation from the extension of the radius to the tool table. That is, by reference to FIG. 2 herein, the angle is negative and positive when the extension of the radius is "below" and "above" the tool table, respectively.

Side rake angle is defined herein as the angle measured in a plane parallel to the wheel spindle which is formed between a table of the tool tip and a line parallel to the wheel spindle. Side rake angles are considered to be positive when measured from a line parallel to the table in a clockwise direction-assuming a left to right tool feed and a clockwise wheel rotation.

Side cutting edge angle is defined as the angle between the leading side of tool (i.e., the right side assuming left to right tool feed) and a plane parallel to the axis of the tool shank.

End cutting edge angle is defined as the angle between the trailing edge of the tool (i.e., the left side of the tool assuming left to right tool feed) and a plane perpendicular to the axis of the tool shank.

Reference can be made to the aforementioned *Machinery's Handbook,* pp. 1992 to 1994 for a listing of commonly used dressing tools and methods for their use. One common type is a single point diamond tool having a granular shaped diamond mounted at one end of a tool shank. (See FIGS. 1, 1A herein.) Dressing is performed with such a tool by engaging the periphery of a rotating wheel with the cylindrical handle of the tool disposed at an angle of 10° to 15° relative to a line drawn perpendicular to a tangent to the wheel periphery at the point of engagement of the tool with the wheel. This is equivalent to a negative back rake angle of about 55° to 60°. (The back rake angle of a single point diamond tool is not easily defined and measured in terms of a face of the diamond tip because of the irregular shape of the tip which varies from one tip to another.) The tool is also occasionally rotated about its longitudinal axis to prolong diamond life by limiting the extent of the wear facets and also to produce a pyramidal shape of the diamond tip.

It is also known to shear the natural diamond tip to reduce the negative back rake angle. Even with the shearing, these tools are used at a negative back rake angle. It is also known to use such tools with the longitudinal axis of the handle at a 0° angle relative to a line perpendicular to the tangent to the wheel periphery at the point of engagement of the tool with the wheel. However, the tip is still at a negative rake angle. (see FIG. 1A herein.)

Another dressing tool which has been recently developed is a tool comprised of a cylindrical tool shank with a composite diamond compact tip fixed at one end. The diamond and carbide layers are oriented parallel to the longitudinal axis of the tool shank. Such composite compacts have been used to dress a grinding wheel by engaging the periphery of the wheel to an exposed edge of the compact with the edge transverse to the diamond layer. The tool is disposed (i) at either a zero degree back rake angle or a negative back rake angle and (ii) at a zero degree side rake angle.

While the prior methods for dressing are generally considered to be satisfactory, manufacturers are always concerned with improving the grinding process, such as by improving wheel life, surface finish on the workpiece produced by the grinding wheel, dressing tool life and dressing speeds.

Accordingly, it is an object of this invention to provide a dressing method which enhances and improves the grinding process in these areas.

Another object of this invention is to provide an improved dressing tool particularly applicable for dressing at positive rake angles.

SUMMARY OF THE INVENTION

These and other objects are accomplished by a dressing method for a grinding wheel comprising the steps of rotating a grinding wheel and engaging with the surface of the wheel a dressing tool disposed at a positive back rake angle, preferably between 5° and 30°. Optionally for certain applications the tool may be disposed at a positive side rake angle. In one preferred embodiment the tipof the dressing tool is a composite compact comprised of a layer of diamond or cubic boron nitride bonded to a cemented tungsten carbide substrate. The compact preferably has a side cutting edge angle between 45° and 75° and a cutting edge angle between 3° and 15°. The disposition of the tool at a positive back rake angle provides a resultant force, applied through the tool to the wheel, which is directed away from the wheel surface, thereby improving the wheel and tool life.

BRIEF DESCRIPTION OF THE DRAWING

FIG. 4A is an elevational view of the dressing tool of FIG. 4 viewed along line 4A—4A.

FIG. 5A is an elevational view of the dressing tool of FIG. 5 viewed along line 5A—5A.

FIG. 6 is a schematic diagram of the forces produced in a prior art dressing method shown in FIGS. 1, 1A in which the tool is disposed at a negative back rake angle in accordance with this invention.

FIG. 7 is a schematic diagram of the forces produced in a dressing method of this invention as shown in FIG. 2 in which the tool is disposed at a positive back rake angle in accordance with this invention.

DESCRIPTION OF THE PREFERRED EMBODIMENTS

Figure 1:
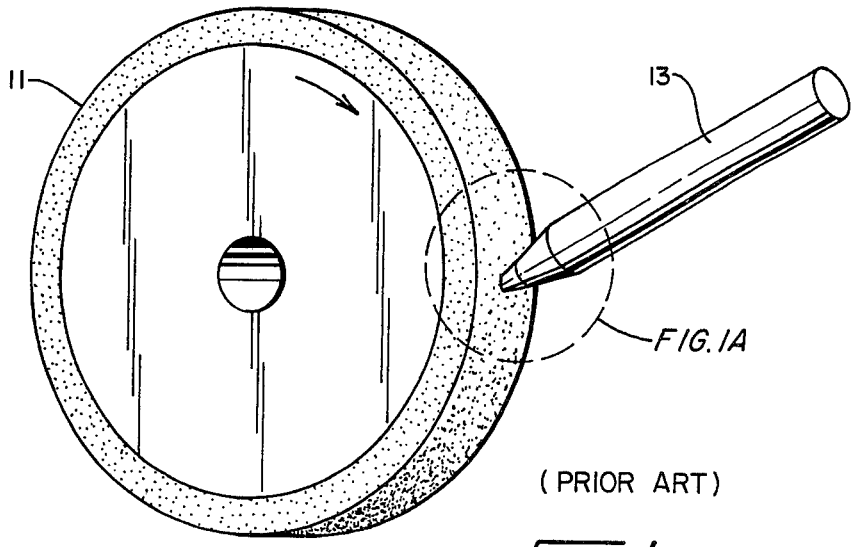
(PRIOR ART) FIG. 1
FIG. 1 is a schematic diagram of a prior art method for dressing a grinding wheel with a single point diamond tool.
Figure 1A:
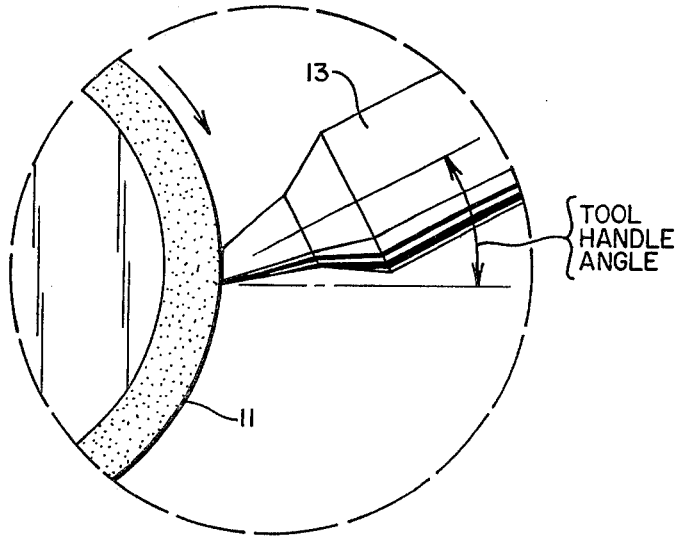
(PRIOR ART) FIG. 1A
FIG. 1A is an enlarged schematic diagram of a portion of FIG. 1

Referring to FIGS. 1, 1A, a prior art method of dressing is shown. A wheel 11 is rotated in a clockwise direction and is dressed by engaging, with the periphery of wheel 11, a dressing tool 13 disposed at a tool hand angle, (measured between the longitudinal axis of the tool handle and line perpendicular to the tangent to the point of contact between the tool 13 and wheel 11), preferably between 10° and 15°. The tool is also canted at about the same angle in the direction of crossfeed (transverse to the wheel surface in a direction parallel to the axis of wheel rotation). In accordance with the aforementioned *Machinery's Handbook*, p. 1995, the depth of cut should not exceed 0.0254 mm. per pass for general work and should be reduced to 0.00508 to 0.01016 mm. per pass for a wheel with fine grains used for finishing work; the speed of rotation of the grinding wheel during dressing should be at the recommended grinding rate; and, for example, the crossfeed per wheel revolution for a wheel with a grain size of 50 is 0.188 to 0.305 mm.

Figure 2:
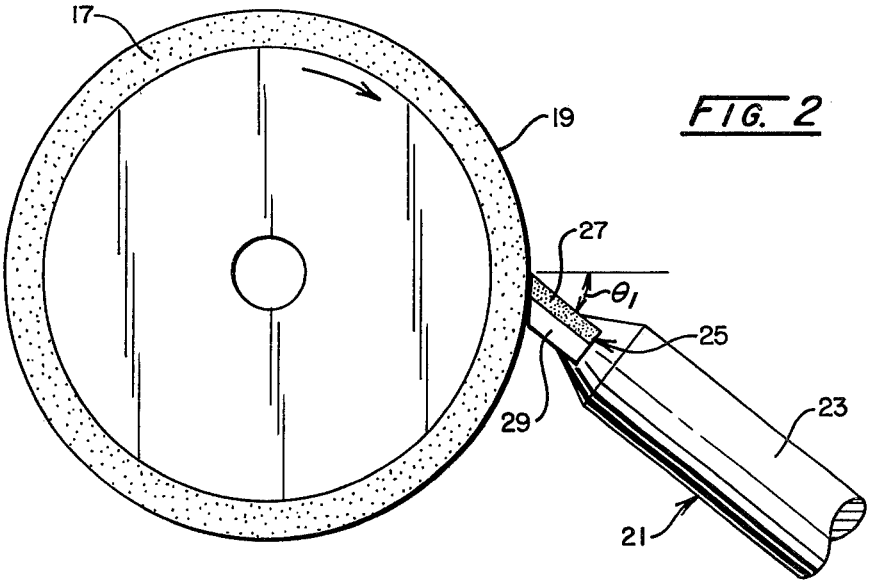
FIG. 2 is a schematic diagram of a dressing method in accordance with the features of this invention.

Referring to FIG. 2, a diagram of a preferred dressing method in accordance with the features of this invention is shown. A wheel 17 is rotated preferably at its normal grinding speed and is dressed by engaging, with the wheel periphery 19, a dressing tool 21 disposed at a positive back rake angle $\theta_1$, between 0° and 45° and preferably between 10° and 20°. The cutting action of tool 21 is provided by a linear cutting or dressing edge 32 defined by the intersection of planar tool table 30 with a surface 31. Tool surface 31 which engages the periphery of the workpiece is inclined relative to table 30 at angle $\theta_2$ the complement of which is approximately equal to the rake angle $\theta_1$. If edge 35 is positioned to intersect the horizontal diameter of wheel 19, this permits surface 31 to be disposed substantially flush with the periphery 19 during dressing if desired. The back rake angle may be varied by rotating tool 23 about edge 32 in a plane parallel to wheel 17 or by maintaining the angular orientation constant and rising or lowering tool 23 relative to the horizontal diameter of wheel 17 (FIG. 2).

Tool 23 is oriented so that layer 27 is substantially parallel to the wheel rotational axis. Also, because layer 27 is harder and more abrasion resistant than layer 29, layer 27 is positioned to face in a direction opposing wheel rotation.

In accordance with the advantages of this invention the use of a cutting edge to dress the wheel surface provides a freer cutting and a more accurately dimensioned wheel surface compared to that which could be achieved with a single point tool. Rather than dull, flat crystals, the compact dressing tool fractures the abrasive grains to leave many fine cutting edges, sharp points, and loosely held particles. This produces an improved surface finish on workpieces ground with a wheel dressed in accordance with this invention.

Figure 3:
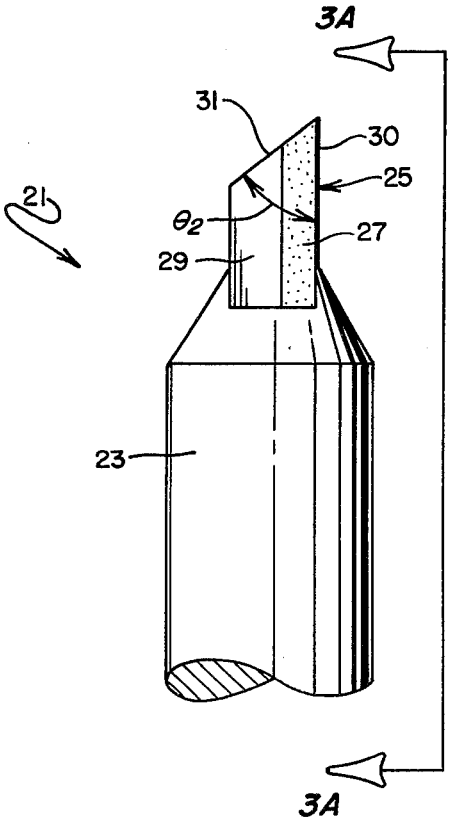
FIG. 3 is a schematic diagram of another dressing method in accordance with the features of this invention.
Figure 3A:
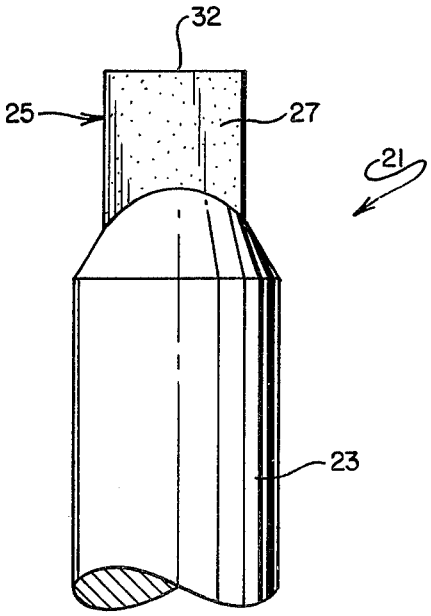

Referring to FIG. 3 an alternate dressing method in accordance with this invention is illustrated schematically. This method has particular utility for dressing wheels used in centerless and cylindrical grinding applications (i.e., in applications where it is less critical to have the tool dressing edge on the center line of the dressing tool feed mechanism). This method is believed to further enhance the free removal of grains and swarf from the grinding wheel surface, thereby providing a sharper, faster cutting wheel.

In this method a wheel 17 is rotated preferably at its normal grinding speed and is dressed by engaging with the wheel periphery 19 a dressing tool 21 disposed (i) at a positive side rake angle $\theta_3$ between 0° and 90° and preferably between 5° and 20° and (ii) at a positive back rake angle $\theta_1$ between 0° and 45° and preferably between 10° and 20°. The cutting action of tool 21 is again provided by a linear cutting or dressing edge 32 defined by the intersection of planar tool table 30 and surface 31.

While it is preferred to dress using a positive side rake angle in combination with a positive back rake angle, it is also possible to dress using a positive side rake angle and in combination a zero or negative back rake angle. However, it is believed that the latter positive/zero or negative rake angle method would be inferior to the positive/positive rake angle method of FIG. 3 in tool life and in the dimensional accuracy of the wheel surface.

In one embodiment (FIGS. 4, 4A) of a dressing tool which may be used in the practice of the methods of FIGS. 2, 3, tool 21 comprises a tool shank 23 and a composite compact 25 mounted at one end of shank 23. Compact 25 includes a laminar mass of layer 27 of bonded abrasive crystals and a laminar substrate 29 of cemented tungsten carbide bonded to mass 27. The abrasive layer 27 may be comprised of an abrasive selected from the group consisting of diamond, cubic boron nitride (CBN), wurtzite boron nitride (WBN) and mixtures of two or more of the foregoing.

In accordance with a preferred embodiment (FIGS. 5, 5A) of a dressing tool of this invention which may be used to practice the methods (FIGS. 2, 3), a dressing tool 51 is comprised of a shank 53 and a composite compact 55 mounted at one end of shank 53. Compact 55, which may be identical construction to compact 25 (FIGS. 4, 4A), includes a laminar mass of layer 57 of bonded abrasive crystals and a laminar substrate 59 of cemented carbide bonded to mass 57. Compact 55 of tool 51 is provided with a face 62 defining a side cutting edge angle which may be between 0° and 90° and is preferably between 45° and 75° and a face 60 defining an end cutting edge angle which may be between 0° and 45° and is preferably between 3° and 15°. A dressing or cutting edge 61 is defined by a face or table 63 and a surface 65. Edge 61 is preferably rounded off so as to form an arcuate surface in a plane perpendicular to table 63.

In the fabrication and shaping of compact 55 for use in dressing tool 51, faces 60, 62 defining said end cutting and side cutting edge angles may be formed on an originally rectangular blank in any conventional manner such as by grinding. Edge 61 may be rounded off also in any conventional manner such as by honing with diamond.

Tool 51 (FIG. 5) has been found to be preferable to tool 21 (FIGS. 4, 4A) with zero degree side cutting and end cutting edge angles because dressing edge 31 is subject (i) to crumble and chip and consequently reduce tool life; and (ii) to deflect the wheel spindle and excessively rub a grinding wheel without actually dressing.

Figure 4:
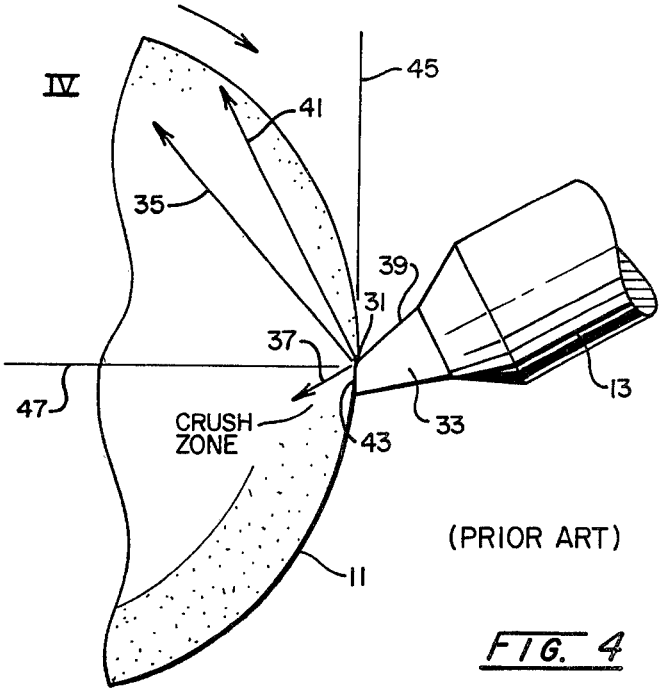
FIG. 4 is an elevational view of one embodiment of a dressing tool in accordance with this invention.
Figure 5:
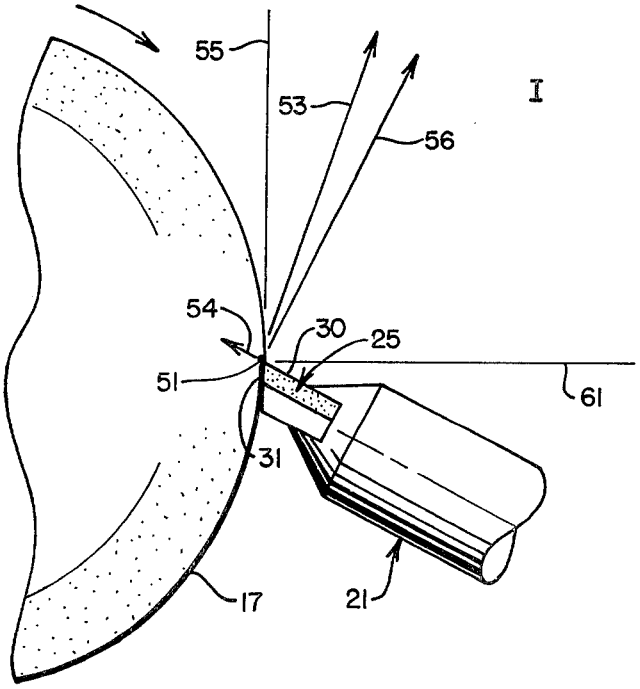
FIG. 5 is an elevational view of a preferred, second embodiment of a dressing tool in accordance with the features of this invention.

The poor performance of a dressing tool in accordance with the embodiment of FIGS. 4, 4A, which is sometimes encountered, is believed to be due in part to the brittleness of the abrasive layer. With a zero side cutting and end cutting edge angle there is a tendency of the compact corners to chip. Such chippage is a serious problem because with a chipped corner it is difficult to remove material from a wheel when dressing. Also, as the dressing tool is fed across and into the wheel surface, the spindle of the wheel deflects and the dresser tends merely to rub the wheel without abrading the surface. Also, a tool with chipped corners tends to dress inaccurately the wheel which can lead to poor workpiece finish and dimensioning.

The diamond and CBN composite compacts are preferably made in accordance with U.S. Pat. Nos. 3,745,623 and 3,743,489, respectively, (incorporated by reference herein). Also, while not preferred, a cluster compact may be substituted for a composite compact as the dressing tool tip. It has been found that the performance of a cluster compact tool is approximately the same as a composite compact tool except that tool life is reduced because the absence of the substrate makes the cluster compact more subject to wear and radical fracture.

The dressing methods of this invention have general application to all wheel bond systems such as metal, resin, vitreous, rubber, shellac, silicate, and oxychloride. The abrasive of the wheel may be selected from any of the conventional abrasives such as diamond, cubic boron nitride, aluminum oxide, silicon carbide, etc.

Referring now to FIGS. 6 and 7, a diagram is shown of the forces applied to a fragment of a grinding wheel dressed in accordance with the prior art method shown in FIGS. 1 and 1A and in accordance with the method of this invention shown in FIG. 2 using a tool as shown in FIGS. 4, 4A. The magnitude and direction of the forces shown in FIGS. 6 and 7 are approximate for the purpose of illustration. In FIG. 6, the grinding wheel 11 is dressed by the application of a tool 13 with a single crystal natural diamond tip 33 to the wheel periphery. As the wheel is rotated, a fragment or particle 31 of the wheel hits the diamond tip 33 and a resultant force 35 comprised of component 37 parallel to an exposed face 39 of diamond tip 33 and of a component 41 normal to face 39 is applied to particle 31. Force 35 is of a magnitude sufficient to break the particle 33 away from the wheel periphery and lies in a quadrant IV defined by a line 45 tangent to the wheel periphery at the point of application of force 35 and a line 47 drawn perpendicular to tangent 45 at the point of application.

With the particle 31 fragmented from wheel 11 and with continued wheel rotation, the direction of force 35 inwardly of wheel 11 creates a crushing zone on the wheel periphery in the region directly adjacent to wear surface 43 where particle 31 is broken up and then passes between a wear surface 43 and the wheel periphery. As the fragment 31 passes between, fragment 31 is tended to be crushed into the wheel. This tends to cause the abrasive particles of the wheel and the bond in the crushing zone to be weakened and broken, thereby permanently damaging the wheel material surface and degrading the resulting performance. In addition, some parts of fragment 31 may be pressed into said wheel surface, causing blockage of the spaces between grains which normally function to carry coolant and promote the free, easy formation of chips and carry same away from the workpiece.

In FIG. 7, a wheel 17 is dressed using a tool 21. As the wheel is rotated and engages table 30 a resultant force 53 comprised of components 54, 56, parallel and perpendicular to face 34 of compact 25, respectively, is applied to a wheel fragment 51. Force 53 has a magnitude sufficient to break away a fragment of the wheel comprised of abrasive particles and/or bond material and lies in a quadrant I defined by a line 55 tangent to the wheel periphery at the point of application of resultant force 53 and a line 61 drawn perpendicular to tangent 55 at the point of application and intersection the axis of rotation of the grinding wheel. In contrast to inwardly directed force 35, associated with the practice of the prior art dressing method, force 53 is directed outwardly of the wheel surface and tends to cause wheel fragments 51 to be thrown away from the surface of the wheel without passing between face 34 and the wheel periphery, thereby reducing damage to the wheel.

To further illustrate the advantages of the invention per se and relative to a prior art dressing, the following tests were conducted.

A plurality of groups of 50 ring-shaped bearings of 52,100 steel were ground on the inner diameter with an 80 grain size aluminum oxide wheel. Grinding speed was 3048 surface m./min. A water based coolant was used.

For each group of 50 parts, the wheel was dressed initially and redressed prior to grinding each bearing with a dressing tool as specified in Table I below. For each group the wheel was dressed using an infeed of 0.0127 mm., a crossfeed of 0.0229 mm./rev., followed by a one second "spark out" (i.e., the tool was not infed additionally during an additional pass of the tool across the wheel).

The second column of Table I indicates the lowest and highest values RMS for the deviation of the surface finish over 50 workpieces ground with the wheel. Column 3 of the Table indicates the average variation in the internal diameter of a workpiece average for the 50 workpieces ground with the wheel.

It is seen from Table I that the performance of a grinding wheel dressed in accordance with this invention is substantially improved over a grinding wheel dressed in accordance with the prior art method described in connection with FIGS. 1 and 1A herein.

TABLE I

| Dressing Tool | Rake Angle (degrees) | Surface Finish Range-RMS ($10^{-7}$ cm.) | Variation in Internal Diameter ($10^{-4}$ cm.) |
|---|---|---|---|
| Single point diamond (prior art) | −40 to −50 (tool axis at 0) | 43–100 | 16–17 |
| diamond composite compact-A | 0 | 18–25 | 18 |
| | 5 | 25–38 | 7.6 |
| | 10 | 18–33 | 10 |
| | 15 | 18–35 | 6.3 |
| diamond composite compact-B | −25 | 33–81 | 20 |
| | −20 | 20–38 | 14 |
| | −15 | 20–33 | 11 |
| | −10 | 25–43 | 11 |
| | −5 | 23–58 | 15 |
| | 0 | 18–33 | 18 |
| | 5 | 23–43 | 16 |
| | 10 | 20–30 | 6.3 |
| | 15 | 15–38 | 10 |
| diamond composite compact-C | 0 | 25–46 | 5 |
| | 5 | 28–51 | 14 |
| | 10 | 18–53 | 7.6 |
| | 15 | 18–35 | 6.3 |
| diamond composite compact-D | 0 | 25–53 | 10 |
| | 5 | 20–51 | 16 |
| | 10 | 20–48 | 11 |
| | 15 | 20–41 | 7.6 |

It was also discovered as a result of the foregoing tests that the length of dressing edge 61 (i.e., the area of surface 65 which engages the wheel surface during dressing) controls surface finish achievable on workpieces ground with a dressed wheel. Specifically, the following conclusions can be drawn.

1. A 1.0 mm. dressing edge for dressing most grinding wheels yielded a 0.25–0.5 micrometer $R_a$ workpiece surface finish. A grinding wheel dressed with this tool is fast and free cutting. Tool life between sharpenings of the tool is shorter than with dressing tools with wider dressing edges. The application of this dressing tool is preferred where a longer cycle time (i.e., the length of wheel grinding time to grind a workpiece) is critically important and surface finish and tool life are secondary
2. A 1.5 mm. dressing edge typically yields a 0.23–0.33 micrometer $R_a$ workpiece surface finish. The grinding wheel remains open and free cutting. Tool life is longer than with the 1.0 mm. edge dressing tool. This dressing tool effectively provides better surface finish and tool life than the 1.0 mm. dressing edge but with increased cycle time.
3. A 2 mm. dressing edge provides a workpiece surface finish of 0.18–0.25 mm. $R_a$. The grinding cycle time is further increased over 1.0 mm. and 1.5 mm. edged tools. However, a further increase in dressing tool life is achieved.

A 2.5 mm. edged tool provides a 0.13–0.20 micrometer workpiece surface finish. However, the wheel is found to load more easily and grind more slowly than the 1.0 mm. to 2.0 mm. edged tools. To achieve the improved surface finish, more heat is generated during the grinding of workpieces with the wheel which results in the increased possibility that the workpiece may be burned. Also, workpiece size control problems may be encountered. If properly used, improved tool life is achieved.

While the invention has been described in connection with certain preferred embodiments thereof, it is not intended that the invention be restricted to the particular description. For example, it has been recognized that while the invention has been illustrated with a dressing tool having a table terminating in a linear edge, it is equally applicable to form dressing tools which have a table terminating in a non-linear edge.

Also, although it is preferred to dress the wheel at normal grinding speeds, a dressing may be accomplished at slower speeds, for example, in the range of 100 to 500 surface meters per minute.

Further, as stated above, while dressing tools comprised of compacts of diamond or boron nitride are preferred; compacts of other abrasives such as tungsten carbide, silicon carbide and aluminum oxide may be used in accordance with this invention.

Accordingly, it is intended that the appended claims cover all such modifications as are within the true spirit and scope of this invention.

We claim:

1. A method for dressing a grinding wheel comprising the steps of rotating said wheel and engaging the periphery of the rotating wheel with a dressing tool having a tip which is a composite compact disposed at a positive back rake angle of between 5 and 30 degrees.

2. The method of claim 1 wherein the back rake angle is between 10° and 20°.

3. The method of claim 1 wherein the side rake angle is between 5° and 20°.

4. The method of claims 1, 2, or 3 wherein said composite compact is comprised of a layer of an abrasive selected from the group consisting of diamond, wurtzite boron nitride, and cubic boron nitride bonded to a cemented tungsten carbide substrate.

5. The method of claims 1, 2, or 3 wherein the bond material of said wheel is selected from the group consisting of metal, resinoid, rubber, shellac, silicate, and oxychloride.

6. The method of claims 1, 2, or 3 wherein the abrasive of said wheel is selected from the group consisting of aluminum oxide, silicon carbide, wurtzite boron nitride, cubic boron nitride, and diamond.

7. The method of claims 1, 2, or 3 wherein said wheel is rotated at normal grinding speeds.

8. The method of claim 1 wherein said dressing tool comprises a composite compact comprising a first layer of bonded abrasive particles and a second layer of cemented carbide bonded to said first layer; said compact having a surface inclined relative to said first layer at an included angle $\theta_2$, the complement of which is approximately equal to said rake angle $\theta_1$.

9. The method of claim 1 wherein said compact comprises first and second faces, said second face inclined relative to said first face at an included angle $\theta_2$, the complement of which is approximately equal to said rake angle $\theta_1$.

10. The method of claim 1 wherein said compact comprises a layer of bonded abrasive particles and an edge defined by the intersection of first and second planar faces of said layer, said second face inclined relative to said first face at an included angle $\theta_2$ where $90° \geqq \theta_2 > 0°$.

11. The method of claim 9 wherein said edge is linear.

12. A method for dressing a grinding wheel comprising a bond system selected from the group consisting of vitrified, resinoid, rubber, shellac, silicate, and oxychloride; and an abrasive selected from the group consisting of aluminum oxide, silicon carbide, boron nitride, and diamond comprising the steps of rotating said wheel at normal grinding speeds and engaging the periphery of the rotating wheel with a dressing tool comprised of a composite compact having a face defining a side cutting edge angle between 45° and 75° and having another face defining an end cutting edge angle between 3° and 15°, said composite compact being comprised of a layer selected from the group consisting of diamond, wurtzite boron nitride and cubic boron nitride on a substrate of cemented tungsten carbide, said tool being disposed at a positive back rake angle between 5 and 30 degrees.

13. The method of claim 12 wherein said tool is disposed at a positive side rake angle between 5° and 20°.

* * * * *